US006685542B2

(12) United States Patent
Mori et al.

(10) Patent No.: US 6,685,542 B2
(45) Date of Patent: Feb. 3, 2004

(54) GRINDING MACHINE

(75) Inventors: Takashi Mori, Tokyo (JP); Hiroshi Sasayama, Tokyo (JP); Toru Takazawa, Tokyo (JP)

(73) Assignee: Disco Corporation, Tokyo (JP)

( * ) Notice: Subject to any disclaimer, the term of this patent is extended or adjusted under 35 U.S.C. 154(b) by 181 days.

(21) Appl. No.: 09/986,408

(22) Filed: Nov. 8, 2001

(65) Prior Publication Data

US 2002/0081954 A1 Jun. 27, 2002

(30) Foreign Application Priority Data

Dec. 27, 2000 (JP) ..... 2000-397610

(51) Int. Cl.[7] ..... B24B 7/04

(52) U.S. Cl. ..... 451/65; 451/66; 451/287; 451/290; 451/332

(58) Field of Search ..... 451/57, 58, 65, 451/66, 70, 278, 285, 287, 290, 332, 333

(56) References Cited

U.S. PATENT DOCUMENTS 2,493,206 A * 1/1950 Okey ..... 451/292
4,829,716 A * 5/1989 Ueda et al. ..... 451/292
6,095,899 A * 8/2000 Elmar et al. ..... 451/28
6,159,071 A * 12/2000 Koma et al. ..... 451/5
6,431,964 B1 * 8/2002 Ishikawa et al. ..... 451/65

* cited by examiner

*Primary Examiner*—Timothy V. Eley
(74) *Attorney, Agent, or Firm*—Wenderoth, Lind & Ponack, L.L.P.

(57) ABSTRACT

A grinding machine includes at least a turntable, rotary chuck tables for holding workpieces to be machined, a first grinding device for grinding the workpiece held on the chuck table and a second grinding device for grinding the first-ground workpiece held on the chuck table. The first grinding device comprises at least a first grinding wheel having pieces of grindstone set so as to define together a first grinding plane, and a first spindle fixed to the first grinding wheel. Likewise, the second grinding device comprises a second grinding wheel having pieces of grindstone set so as to define together a second grinding plane and a second spindle fixed to the second grinding wheel. The first and second grinding devices are so arranged that the first angle formed between the linear line connecting from the center of rotation of the turntable to the center of rotation of a selected chuck table and the linear line connecting from the center of rotation of the selected chuck table to the center of rotation of the first spindle is equal to the second angle formed between the linear line connecting from the center of rotation of the turntable to the center of rotation of the selected chuck table and the linear line connecting from the center of rotation of the selected chuck table to the center of rotation of the second spindle. This arrangement assures that all finished workpieces have the same thickness.

7 Claims, 7 Drawing Sheets

GRINDING MACHINE

BACKGROUND OF THE INVENTION

1. Field of the Invention

The present invention relates to a grinding machine for use in grinding plate-like objects such as semiconductor wafers.

2. Related Art

Referring to FIG. 7, a plate-like object such as a semiconductor wafer W is attached to a chuck table 60 with its rear side up by using a protective tape T between its front side and the top surface of the chuck table 60. The rear side of the semiconductor wafer W is ground by a grinding means 70.

The grinding means 70 comprises a rotary spindle 71, a mount 72 integrally connected to the rotary spindle 71 and a grinding wheel 73 fixed to the mount 72. The annular grinding wheel 73 has pieces of grindstone 74 fixed to its lower surface, as seen from FIG. 8. While the grinding wheel 73 is made to rotate, the grinding means 70 is lowered until the pieces of grindstone 74 have been applied to the rear side of the semiconductor wafer W under pressure, thereby grinding the rear surface of the semiconductor wafer W.

The semiconductor wafer W is coarse-ground until it has a predetermined thickness, and then the coarse-ground semiconductor wafer W is fine-ground so that it may have a smooth flat surface. The grinding machine is equipped with two grinding means 74, which are provided with pieces of coarse- and fine-grindstone respectively.

Referring to FIG. 9, a turntable 80 has plural chuck tables (three chuck tables 83, 84 and 85 in the drawing) rotatably supported thereon. By turning the turntable 80 about its center of rotation 80*a*, selected chuck tables are brought to and put below first and second grinding means 81 and 82, which carry out coarse-grinding and fine-grinding, respectively. The chuck tables 83, 84 and 85 can rotate about their pivots 83*a*, 84*a* and 85*a*.

As seen from FIG. 9, the first grinding means 81 and the second grinding means 82 are so positioned relative to each other that the straight line L1 passing through the center of rotation 81*a* of the first grinding means 81 and the center of rotation 84*a* of the chuck table 84, which is put below the first grinding means 81, may be parallel to the straight line L2 passing through the center of rotation 82*a* of the second grinding means 82 and the center of rotation 85*a* of the chuck table 85, which is put below the second grinding means 85. The semiconductor wafer W fixedly held by the chuck table 84 is coarse-ground by the first grinding means 81 whereas the semiconductor wafer W fixedly held by the chuck table 85 is fine-ground by the second grinding means 82.

Semiconductor wafers can be put in and taken out from the area at which the chuck table 83 is positioned. Thus, a finished semiconductor wafer can be removed from the chuck table when it is brought to the area, and an unfinished semiconductor wafer can be put on and fixedly attached to the chuck table while it is located there.

Referring to FIG. 9 again, pieces of grindstone 93 set on an annular grinding wheel 92 of the second grinding means 82 pass through the center of rotation 85*a* of the chuck table 85 to rub against the semiconductor wafer W evenly while the chuck table 85 rotates about its center of rotation. Thus, a semiconductor wafer of predetermined thickness results.

Referring to FIG. 10, the chuck table 83, 84 or 85 has a circular conical surface 83*b*, 84*b* or 85*b* formed on its top.

For example, the chuck table is 200 mm in diameter, and the circular conical shape is 10 $\mu$m high at its center. Now, it is assumed that the rotary axis 84*a* of the chuck table 84 is so tilted by turning its adjustment screws 95 and 96 that the grinding plane 94 defined by the pieces of grindstone 93 of the second grinding means 82 may be parallel to the top surface 84*b* of the chuck table 84 radially at an annular sector area 91 at which a required fine-grinding is effected on the semiconductor wafer W, as seen from FIG. 11.

When the chuck table 84 was positioned below the first grinding means 81 (see FIG. 9), a grinding plane 88 defined by the pieces of grindstone 87 of the first grinding means 81 was not parallel to the top surface 84*b* of the chuck table 84 radially at an annular sector area 90 at which a required coarse-grinding was effected on the semiconductor wafer W, as seen from FIG. 12.

As a result, the semiconductor wafer W was coarse-ground to be concave more or less, thus making its thickness uneven. Then, the concave wafer is subjected to the fine-grinding when the chuck table 84 is brought to and put below the second grinding means 82. Even though the grinding plane 94 defined by the pieces of grindstone 93 of the second grinding means 82 is kept parallel to the top surface 84*b* of the chuck table 84 radially at the annular sector area 91, the uneven thickness of the semiconductor wafer cannot be corrected, and therefore, the finished semiconductor wafer of uneven thickness results.

On the contrary, it is assumed that the rotary axis 84*a* of the chuck table 84 is so tilted that the grinding plane defined by the pieces of grindstone 88 of the first grinding means 81 may be parallel to the top surface 84*b* of the chuck table 84 radially at the annular sector area 90 at which a required coarse-grinding is effected on the semiconductor wafer W.

When the chuck table 84 is positioned below the second grinding means 82, the grinding plane 94 of the second grinding means 82 is not parallel to the top surface 84*b* of the chuck table 84 radially at the annular sector area 91 at which a required fine-grinding is effected on the semiconductor wafer W. Accordingly, the precision with which the fine-grinding is effected is lowered. This is the same with the chuck table 83 or 85.

SUMMARY OF THE INVENTION

In view of the above, one object of the present invention is to provide a grinding apparatus which is capable of effecting the coarse- and fine-grinding with precision.

To attain this object, a grinding machine comprises: at least a turn table; chuck tables for holding workpieces to be machined, the chuck tables being rotatably fixed to the turntable; a first grinding means for grinding the exposed surface of each work piece held on the chuck table; and a second grinding means for grinding the exposed and first-ground surface of each workpiece. The grinding machine is improved according to the present invention in that the first grinding means includes at least a first grinding wheel having pieces of grindstone so fixedly arranged as to define together a first grinding plane, a first spindle unit having a rotary spindle fixed to the first grinding wheel; the second grinding means includes at least a second grinding wheel having pieces of grindstone so fixedly arranged as to define together a second grinding plane and a second spindle unit having a rotary spindle fixed to the second grinding wheel, and the first and second grinding means are so arranged that the grinding area formed on the workpiece by the first grinding wheel at the time the workpiece is being ground by the first grinding wheel corresponds to the grinding area formed on the workpiece by the second grinding wheel at the time the workpiece is being ground by the second grinding wheel.

The first and second grinding means may be so arranged that a first angle formed between a linear line connecting from a center of rotation of the turntable to a center of rotation of a selected chuck table when the workpiece is being ground by the first grinding means and a linear line connecting from a center of the selected chuck table to a center of rotation of the rotary spindle of the first spindle unit when the workpiece is being ground by the first grinding means is equal to a second angle formed between a linear line connecting from the center of rotation of the turntable to the center of rotation of the selected chuck table when the work piece is being ground by the second grinding means and a linear line connecting from the center of rotation of the selected chuck table to the center of rotation of the rotary spindle of the second spindle unit when the workpiece is being ground by the second grinding means.

The first and second angles may be 180 degrees.

Once the first grinding plane provided by the first grinding means has been put in parallel with the wafer-bearing surface of a selected chuck table radially at the confronting annular sector area, it is assured that the wafer-bearing surface of the selected chuck table is put in parallel with the second grinding plane provided by the second grinding means radially at the confronting annular sector area when the turntable is rotated to put the selected chuck table under the second grinding means. Thus, all finished semiconductor wafers can have the same thickness.

Other objects and advantages of the present invention will be understood from the following description of preferred embodiments of the present invention, which is shown in accompanying drawings.

DETAILED DESCRIPTION OF PREFERRED EMBODIMENT

Figure 1:
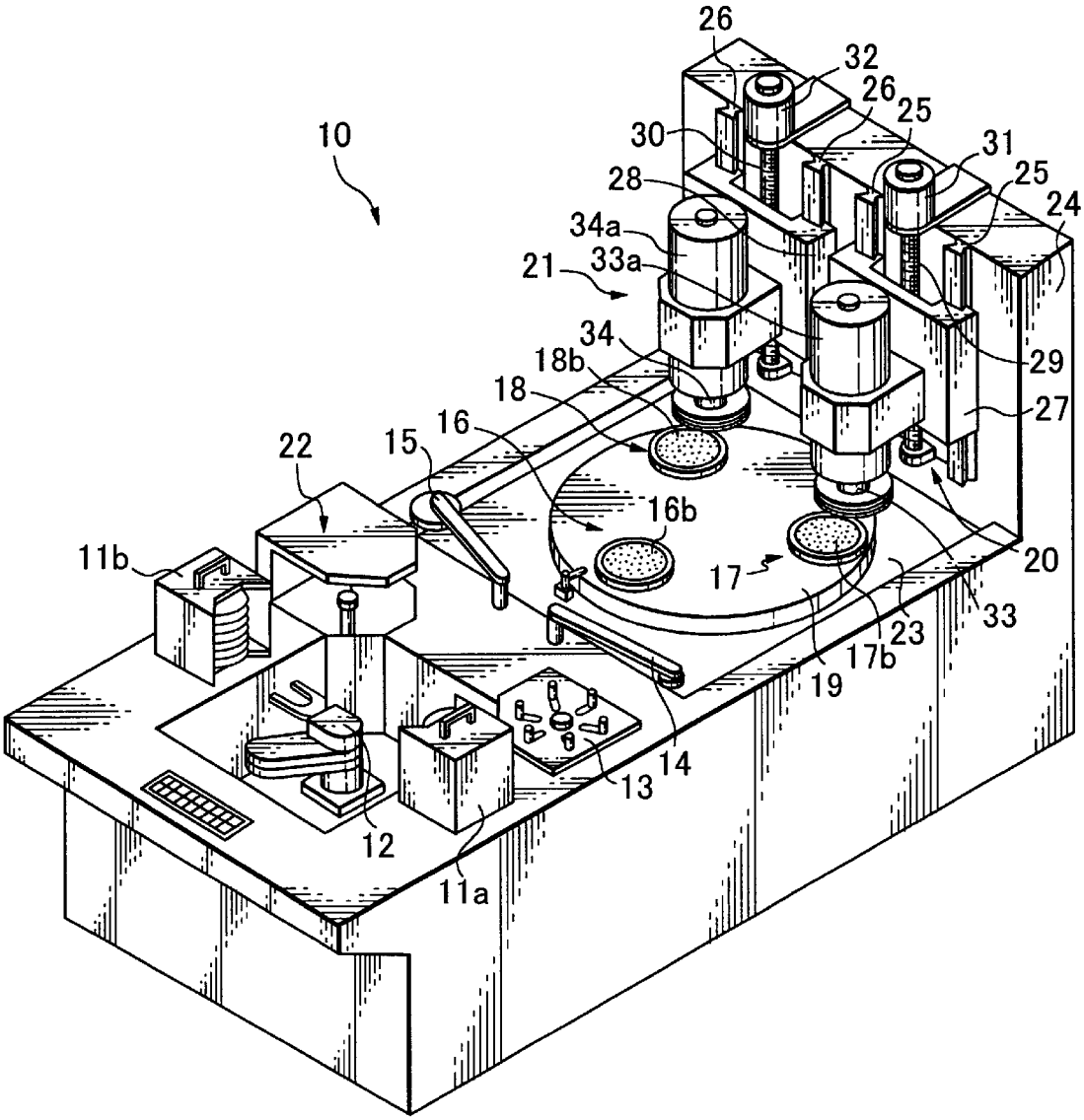
FIG. 1 is a perspective view of a grinding machine of the type which can be improved according to the present invention.

Referring to FIG. 1, a grinding machine 10 can be used in effecting first, coarse-grinding and second, fine-grinding on the rear side of a semiconductor wafer.

As shown, the grinding machine 10 comprises two cassettes 11*a* and 11*b* for containing plate-like objects such as semiconductor wafers to be ground, means 12 for taking semiconductor wafers out of the cassette 11*a* and putting them into the cassette 11*b*, a centering table 13 for putting a selected semiconductor wafer taken out from the cassette 11*a* in transferring position, first and second transporting means 14 and 15, chuck tables 16, 17 and 18 for sucking and holding semiconductor wafers, a turntable 19 having the chuck tables 16, 17 and 18 rotatably fixed thereto, first and second grinding means 20 and 21 for coarse- and fine-grinding semiconductor wafers, and washing means 22 for washing semiconductor wafers subsequent to grinding.

The grinding machine 10 has an upright wall 24 standing from its base 23, and two sets of guide rails 25 and 26 are laid on the upright wall 24. Each set of guide rails 25 or 26 has a carrier 27 or 28 riding thereon, and the carrier has a rotary screw rod 29 or 30 threadedly engaged with its female-threaded mount. The rotary screw rod 29 or 30 is laid on the upright wall 24 (in the Z-axial direction), and is connected to the shaft of an associated stepping motor 31 or 32, which is fixed to the top of the upright wall 24.

The carrier 27 or 28 is engaged with the rotary screw rod 29 or 30 via its nut (not shown) so that the carrier may be driven up and down by rotating the rotary screw rod 29 or 30 by the stepping motor 31 or 32. Each carrier has a linear scale attached inside, thereby permitting the vertical position of the carrier to be determined with precision.

Figure 2:
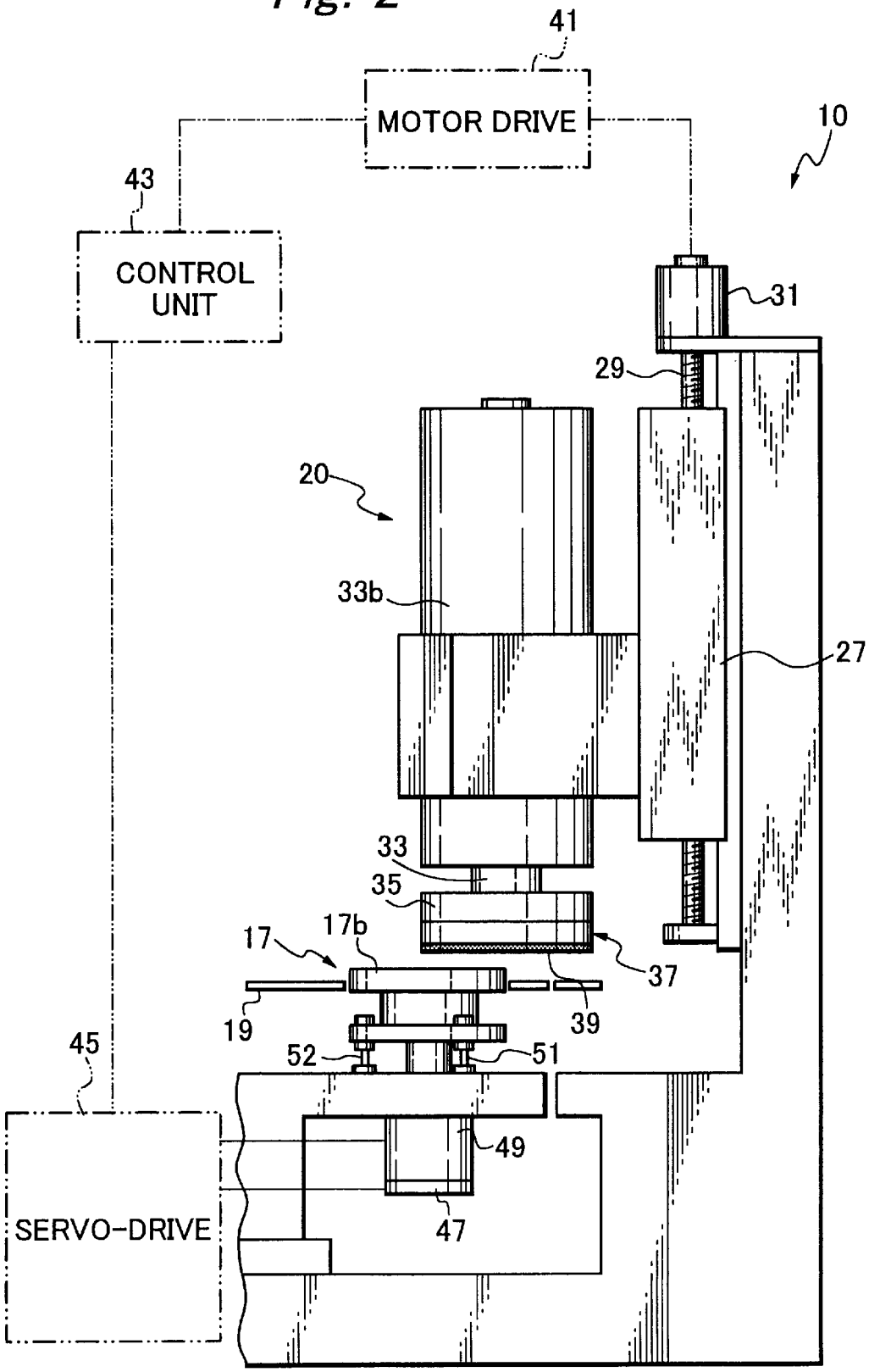
FIG. 2 shows the structure of the grinding machine of FIG. 1.

The first grinding means 20 is fixed to the carrier 27 whereas the second grinding means 21 is fixed to the carrier 28. These grinding means 20 and 21 can be moved vertically by the carriers 27 and 28. Referring to FIG. 2, the first grinding means 20 comprises a spindle unit 33*b*, a spindle 33 rotatably supported by the spindle unit 33*b* and a mount 35 fixed to the spindle 33. The mount 35 has a grinding wheel 37 attached to its lower surface, and the grinding wheel 37 has segments of coarse grindstone 39 fixed to its lower surface. The second grinding means 21 is different from the first grinding means only in that the grinding wheel 38 has segments of fine grindstone 40 fixed to its lower surface.

The stepping motor 31 is connected to a control unit 43 via a motor drive 41. The first grinding means 20 is raised and lowered by controlling rotation of the rotary screw rod 29 under the control of the control unit 43. The vertical position of the carrier 27 is determined by the linear scale so that a signal representing the vertical position of the carrier 27 may be sent to the control unit 43 for precision vertical control.

The control unit 43 is connected to a servo-drive 45, which is connected to an encoder 47 and a servomotor 49, which is connected to a selected chuck table 17. Thus, the chuck table 17 can be rotated under the control of the control unit 43.

Figure 3:
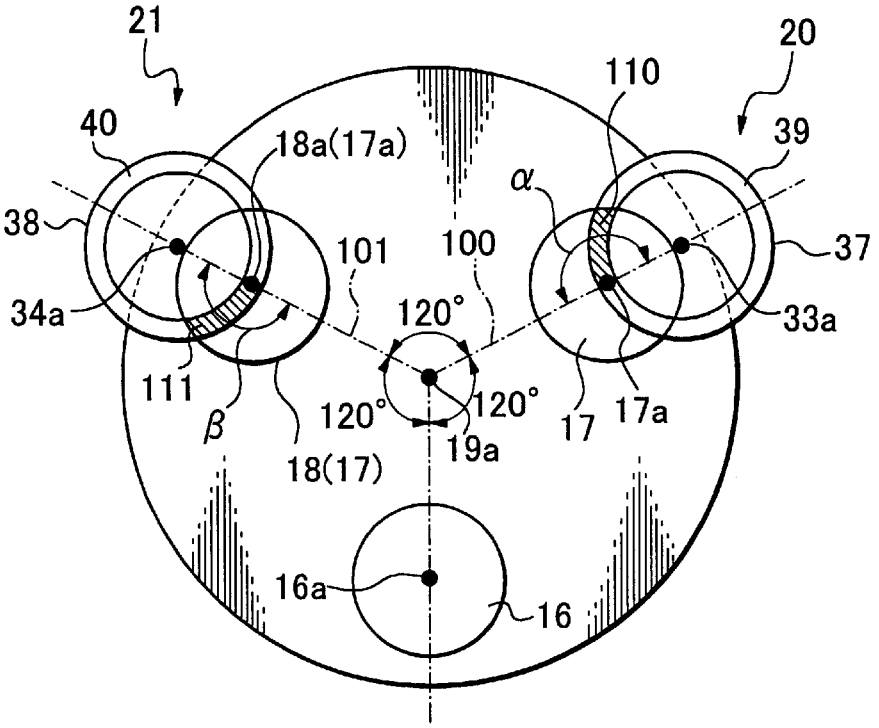
FIG. 3 illustrates how a turntable, chuck tables and first and second grinding means are positioned relative to each other according to a first embodiment of the present invention.

Referring to FIG. 3, three chuck tables 16, 17 and 18 are arranged 120 degrees apart from each other on the turn table 19, which can turn about its center of rotation 19*a*.

The first grinding means 20 is so positioned that the center of rotation 33*a* of the spindle 33 may be put on the extension of the line 100 connecting the center of rotation 19*a* of the turntable 19 and the center of rotation 17*a* of the chuck table 17 whereas the second grinding means 21 is so positioned that the center of rotation 34*a* of the spindle 34 may be put on the extension of the line 101 connecting the center of rotation 19*a* of the turntable 19 and the center of rotation 18*a* of the chuck table 18, which exactly corresponds to the center of rotation 17*a* of the chuck table 17 when it is brought there by turning the turntable 120 degrees.

The rotary axis 17*a* of the chuck table 17 is so tilted by turning its adjustment screws 51 and 52 (see FIG. 2) that the grinding plane defined by the pieces of grindstone 39 of the first grinding means 20 may be parallel to the top surface 17*b* of the chuck table 17 radially at the annular sector area 110 at which a required coarse-grinding is effected on the semiconductor wafer. Then, the semiconductor wafer can be ground evenly to a predetermined thickness by rubbing the semiconductor wafer by the pieces of coarse grindstone 39, the grinding plane defined thereby being kept in contact with the rear side of the semiconductor wafer on the chuck table 17 radially at the annular sector area 110, as seen from FIG. 3.

When the turntable 19 is rotated 120 degrees to put the chuck table 17 under the second grinding means 21, the grinding plane defined by the pieces of grindstone 40 of the second grinding means 21 can be put necessarily in parallel with the top surface 17*b* of the chuck table 17 radially at the annular sector area 111 at which a required fine-grinding is effected on the semiconductor wafer. This is because the positional relationship with which the center of rotation 17*a* of the chuck table 17 is arranged relative both to the center of rotation 33*a* of the first grinding means 20 and to the center of rotation 19*a* of the turntable 19 corresponds to the positional relationship with which the center of rotation 17*a* of the chuck table 17 is arranged relative both to the center of rotation 34*a* of the second grinding means 21 and to the center of rotation 19*a* of the turntable 19, thereby making the first annular sector area 110 at which a required coarse-grinding is effected radially on the semiconductor wafer be in agreement with the second annular sector area 111 at which a required fine-grinding is effected radially on the semiconductor wafer.

In effecting a coarse-grinding on a semiconductor wafer held on the chuck table 17, the chuck table 17 is so positioned that the center of rotation 33*a* of the spindle 33 may be put on the extension from the linear line connecting the center of rotation 19*a* of the turntable 19 and the center of rotation 17*a* of the chuck table 17.

Figure 4:
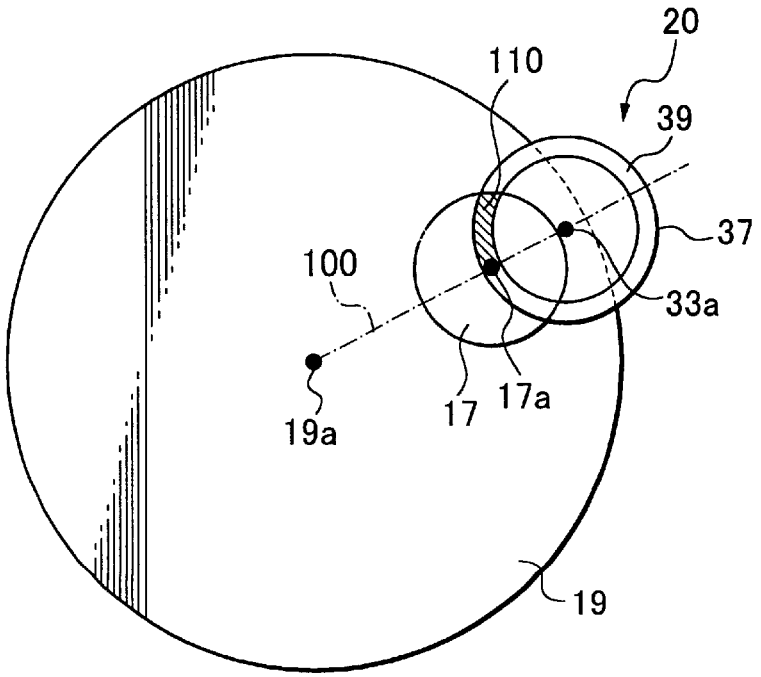
FIG. 4 illustrates how the turntable, a selected chuck table and the first grinding means are positioned relative to each other in coarse-grinding according to the first embodiment of the present invention.

Then, the chuck table 17 is rotated about its center of rotation, and the first grinding means 20 is lowered while the grinding wheel 37 is rotated, thereby pushing the grinding plane defined by the pieces of coarse-grindstone 39 against the rear surface of the semiconductor wafer at the first annular sector area 110 to effect a coarse-grinding on the semiconductor wafer (see FIG. 4). As the wafer bearing surface of the chuck table 17 is adjusted to be parallel to the grinding plane radially at the first annular sector area 110, the coarse-grinding can be effected with precision. As the grinding plane is allowed to pass through the center of rotation 17*a* of the chuck table 17 while the chuck table 17 is rotating about its center of rotation, the whole rear surface of the semiconductor wafer can be evenly ground without leaving any part of the rear surface unpolished.

After completing the coarse grinding, the turntable 19 is rotated 120 degrees to put the chuck table 17 under the spindle 34 of the second grinding means with the center of rotation 34*a* of the second spindle 34 put on the extension from the linear line connecting the center of rotation 19*a* of the turntable 19 and the center of rotation 17*a* of the chuck table 17.

Figure 5:
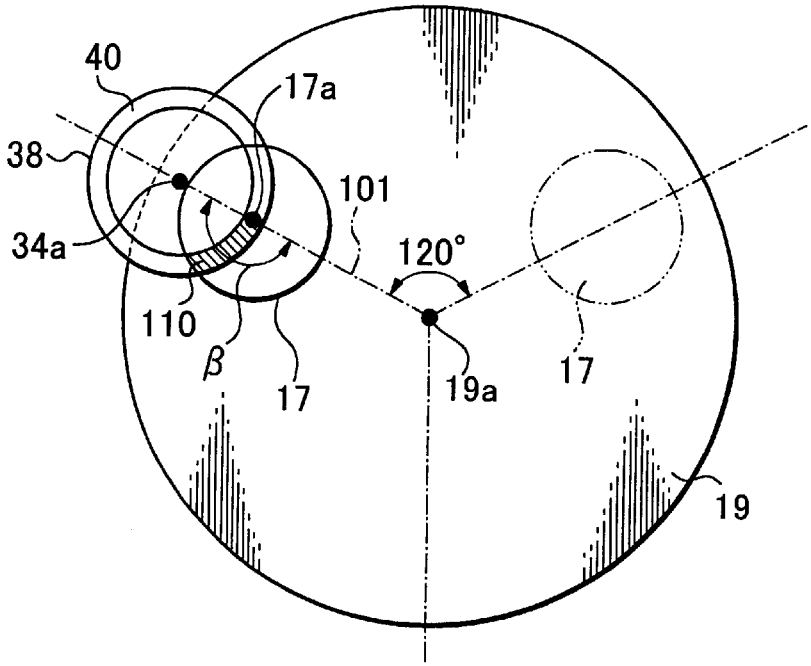
FIG. 5 illustrates how the turntable, the selected chuck table and the second grinding means are positioned relative to each other in fine-grinding according to the first embodiment of the present invention.

Then, the chuck table 17 is rotated about its center of rotation, and the second grinding means 21 is lowered while the grinding wheel 38 is rotated, thereby pushing the grinding plane defined by the pieces of fine-grindstone 40 against the rear surface of the semiconductor wafer radially at the second annular sector area 110 to effect a fine-grinding on the semiconductor wafer (see FIG. 5). As shown, the annular arrangement of pieces of grindstone 40 traverses the center of rotation 17*a* of the chuck table 17.

The angle $\alpha$ formed between the linear line connecting from the center of rotation 19*a* of the turntable 19 to the center of rotation 17*a* of the chuck table 17 and the linear line connecting from the center of rotation 17*a* of the chuck table 17 to the center of rotation 33*a* of the spindle 33 is 180 degrees as viewed in the direction in which the turntable 19 is rotated (see FIGS. 3 and 4). Likewise, the angle $\beta$ formed between the linear line connecting from the center of rotation 19*a* of the turntable 19 to the center of rotation 17*a* of the chuck table 17 and the linear line connecting from the center of rotation 17*a* of the chuck table 17 to the center of rotation 34*a* of the spindle 34 is 180 degrees as viewed in the direction in which the turntable 19 is rotated (see FIG. 5).

The angle $\alpha$ (see FIGS. 3 and 4) is equal to the angle $\beta$ (see FIG. 5), and therefore, the second annular working sector area 110 is positioned with respect to the centers of rotation both of the chuck table 17 and the second spindle 34 (see FIG. 5) in the same way as the first annular working sector area 110 is positioned with respect to the centers of rotation both of the chuck table 17 and the first spindle 33 (see FIG. 4). Thus, the fine-grinding can be effected with the grinding plane defined by the pieces of grindstone 40 parallel to the wafer bearing surface of the chuck table 17 as is the case with the coarse-grinding.

Therefore, the coarse-grinding and the fine-grinding can be effected in one and same condition except for the kinds of grindstone used in the annular working sector areas 110 and 111. Thus, the finished semiconductor wafers have one and the same even thickness as desired.

Figure 6:
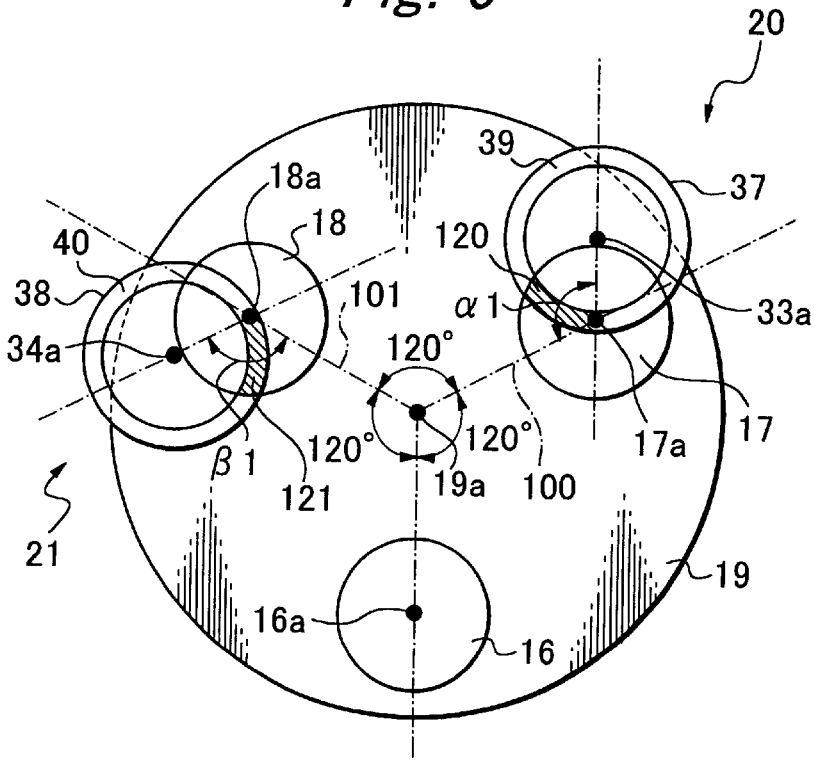
FIG. 6 illustrates how a turntable, chuck tables and first and second grinding means are positioned relative to each other according to a second embodiment of the present invention.
Figure 7:
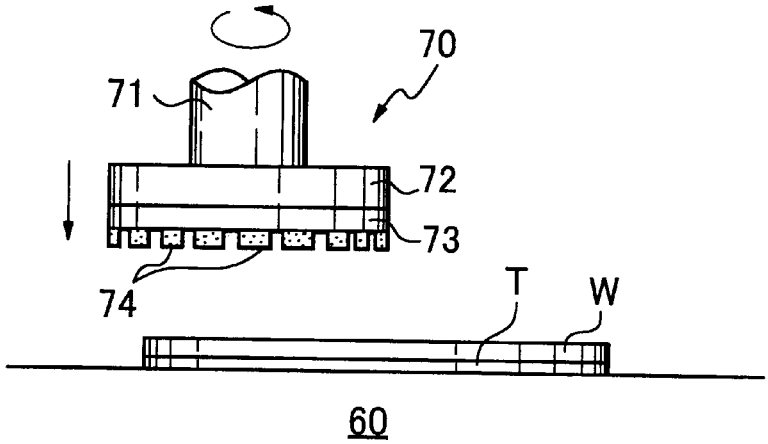
FIG. 7 illustrates how a semiconductor wafer held on a selected chuck table with its rear side up is ground.
Figure 8:
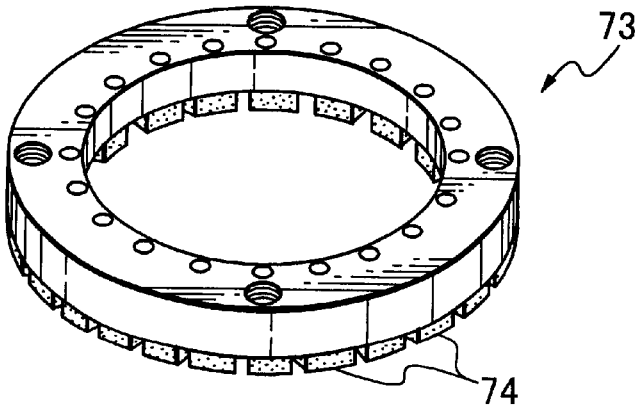
FIG. 8 is a perspective view of an annular grinding wheel of a grinding machine.
Figure 9:
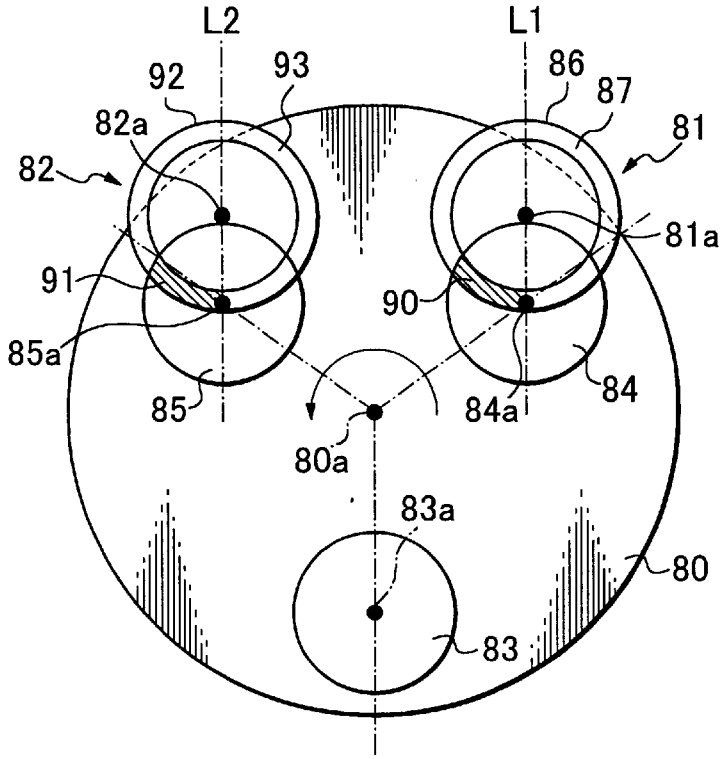
Fig. 9 PRIOR ART
FIG. 9 illustrates how a turntable, chuck tables and grinding means are positioned relative to each other in a conventional grinding machine.
Figure 10:
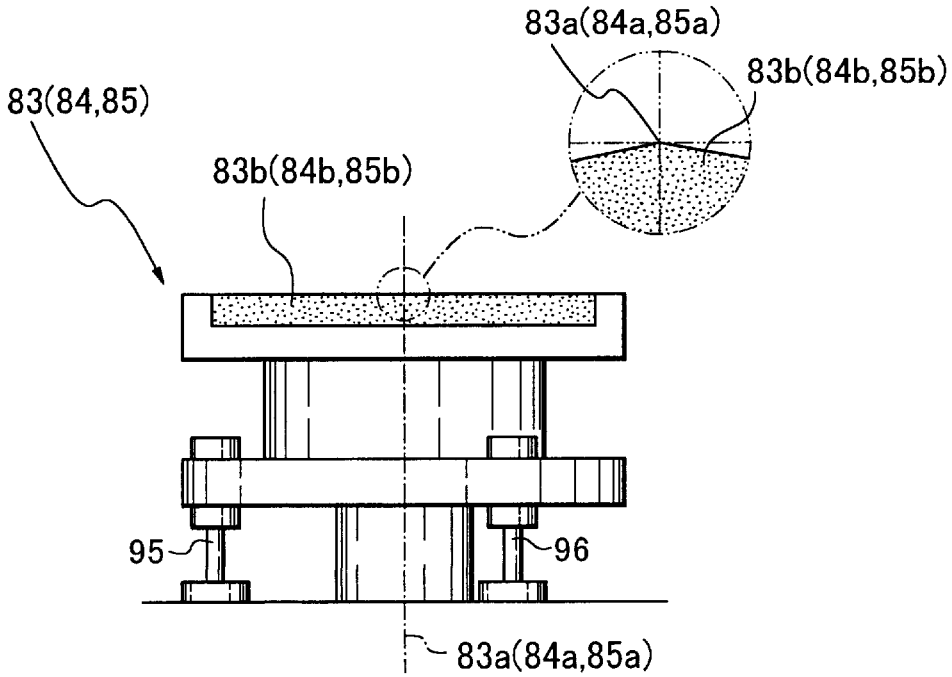
Fig. 10 PRIOR ART
FIG. 10 is a side view of a chuck table at an enlarged scale.
Figure 11:
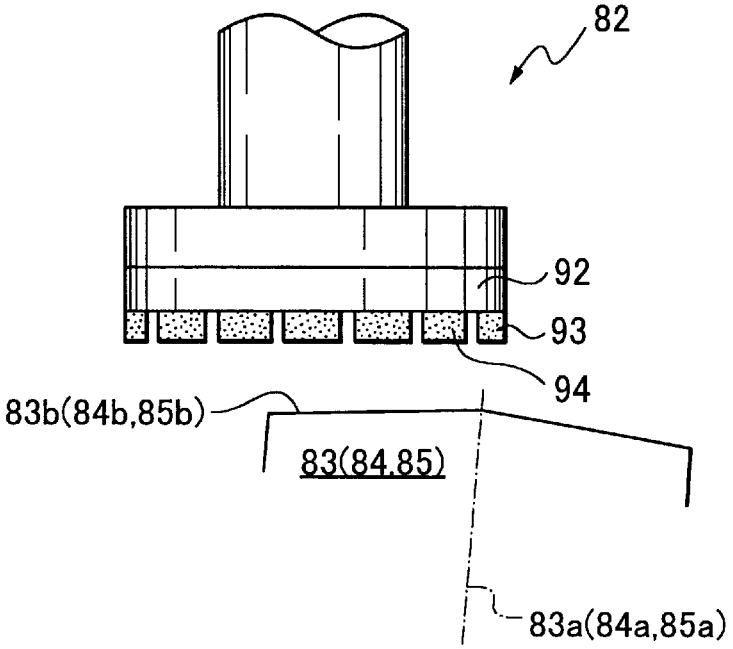
Fig. 11 PRIOR ART
FIG. 11 illustrates how the chuck table is positioned relative to the second grinding means radially at the grinding area in the conventional grinding machine.
Figure 12:
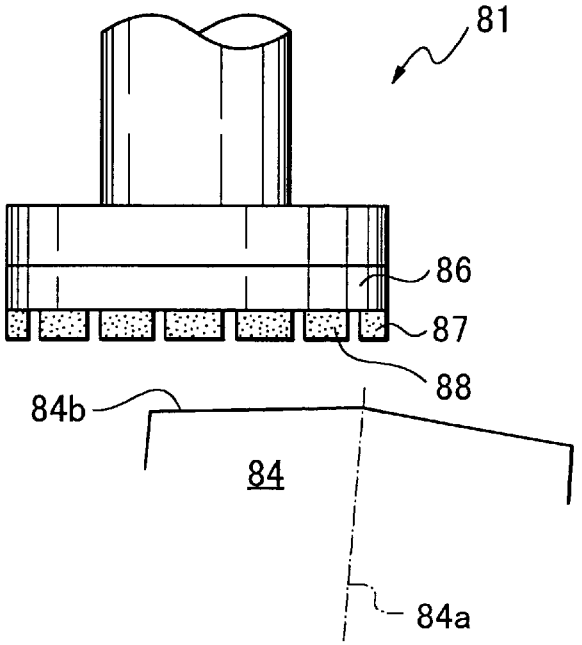
Fig. 12 PRIOR ART
FIG. 12 illustrates how the chuck table is positioned relative to the first grinding means radially at the grinding area in the conventional grinding machine.

The positional relation between the first and second grinding means 20 and 21 as shown in FIG. 3 should not be understood as limitative. The first and second grinding means can be arranged as shown in FIG. 6, where the angle $\alpha 1$ formed between the linear line connecting from the center of rotation 19*a* of the turntable 19 to the center of rotation 17*a* of the chuck table 17 and the linear line connecting from the center of rotation 17*a* of the chuck table 17 to the center of rotation 33*a* of the first spindle 33 as viewed in the direction in which the turntable 19 is rotated, is equal to the angle $\beta 1$ formed between the linear line connecting from the center of rotation 19*a* of the turntable 19 to the center of rotation 17*a* of the chuck table 17 and the linear line connecting from the center of rotation 17*a* of the chuck table 17 to the center of rotation 34*a* of the second spindle 34 as viewed in the direction in which the turntable 19 is rotated. The first and second annular working sector areas 120 and 121 are symmetric with respect to the radial extension from the center of rotation 19*a* of the turntable 19 to the center of rotation of the chuck table 17, positioned for coarse- and fine-grindings.

As may be understood from the above, when the turntable 19 is rotated 120 degrees, the first annular working sector area 120 is put in registration with the second annular working sector area 121, provided that the angle $\alpha 1$ is equal to the angle $\beta 1$, and therefore, the coarse- and fine-grindings can be effected in one and the same working condition except for the kinds of grindstone used. Thus, the finished semiconductor wafers have one and the same even thickness as desired.

In the embodiments described above, the grinding plane defined by the pieces of grindstone is put radially in parallel with the wafer bearing surface of the chuck table. This, however, should not be understood as limitative. In a case where the workpiece is concave or convex, the grinding plane may be put in a given fixed angular relation with the chuck table.

What is claimed is:

1. A grinding machine comprising:

a turntable;

a plurality of chuck tables rotatably mounted to said turntable for holding semiconductor wafers, respectively, at plural positions including a first grinding position and a second grinding position;

a first grinding device for grinding an exposed surface of the semiconductor wafer held on each of said chuck tables, when the chuck table is positioned at the first grinding position by said turntable, to make the exposed surface of the semiconductor wafer into a first-ground surface;

a second grinding device for grinding the first-ground surface of the semiconductor wafer held on each of said chuck tables when the chuck table is positioned at a second grinding position by said turntable;

wherein said first grinding device includes a first grinding wheel having pieces of grindstone so fixedly arranged as to define together a first grinding plane, and a first spindle unit having a rotary spindle fixed to said first grinding wheel;

wherein said second grinding device includes a second grinding wheel having pieces of grindstone so fixedly arranged as to define together a second grinding plane, and a second spindle unit having a rotary spindle fixed to said second grinding wheel;

wherein each of said plurality of chuck tables has a top surface formed of a conical shape;

wherein each of said plurality of chuck tables has a rotary axis which is so tilted that said first grinding plane is parallel to the top surface of the respective chuck table radially at an annular sector area of said top surface thereof, when the respective chuck table is positioned at said first grinding position;

wherein each of said plurality of chuck tables has a rotary axis which is so tilted that said second grinding plane is parallel to the top surface of the respective chuck table radially at an annular sector area of said top surface thereof, when the respective chuck table is positioned at said second grinding position; and wherein said first and second grinding devices are so arranged that a first angle formed between a linear line connecting from the center of rotation of said turntable to the center of rotation of one of said chuck tables when positioned at said first grinding position and a linear line connecting from the center of rotation of said one of said chuck tables when positioned at said first grinding position to the center of rotation of said rotary spindle of said first spindle unit is equal to a second angle formed between a linear line connecting from the center of rotation of said turntable to the center of rotation of one of said chuck tables when positioned at said second grinding position and a linear line connecting from the center of rotation of said one of said chuck tables when positioned at said second grinding position to the center of rotation of said rotary spindle of said second spindle unit, such that an area on the respective semiconductor wafer ground by said first grinding wheel corresponds to an area on the respective semiconductor wafer ground by said second grinding wheel.

2. A grinding machine according to claim 1, wherein each of said first and second angles is 180 degrees.

3. A grinding machine according to claim 1, further comprising adjustment screws operably coupled to each of said chuck tables to adjust tilting of each of said chuck tables.

4. A grinding machine according to claim 1, further comprising an adjustment mechanism operably coupled to each of said chuck tables to adjust tilting of each of said chuck tables.

5. A grinding machine comprising:

a turntable;

a plurality of chuck tables rotatably mounted to said turntable for holding semiconductor wafers, respectively, at plural positions including a first grinding position and a second grinding position;

a first grinding device for grinding an exposed surface of the semiconductor wafer held on each of said chuck tables, when the chuck table is positioned at the first grinding position by said turntable, to make the exposed surface of the semiconductor wafer into a first-ground surface;

a second grinding device for grinding the first-ground surface of the semiconductor wafer held on each of said chuck tables when the chuck table is positioned at a second grinding position by said turntable;

wherein said first grinding device includes a first grinding wheel having pieces of grindstone so fixedly arranged as to define together a first grinding plane, and a first spindle unit having a rotary spindle fixed to said first grinding wheel;

wherein said second grinding device includes a second grinding wheel having pieces of grindstone so fixedly arranged as to define together a second grinding plane, and a second spindle unit having a rotary spindle fixed to said second grinding wheel;

wherein adjustment mechanisms are operably coupled to each of said chuck tables to adjust tilting of each of said chuck tables such that said first grinding plane is parallel to the top surface of the respective chuck table radially at an annular sector area of said top surface thereof when the respective chuck table is positioned at said first grinding position, and such that said second grinding plane is parallel to the top surface of the respective chuck table radially at an annular sector area of said top surface thereof when the respective chuck table is positioned at said second grinding position; and wherein said first and second grinding devices are so arranged that a first angle formed between a linear line connecting from the center of rotation of said turntable to the center of rotation of one of said chuck tables when positioned at said first grinding position and a linear line connecting from the center of rotation of said one of said chuck tables when positioned at said first grinding position to the center of rotation of said rotary spindle of said first spindle unit is equal to a second angle formed between a linear line connecting from the center of rotation of said turntable to the center of rotation of one of said chuck tables when positioned at said second grinding position and a linear line connecting from the center of rotation of said one of said chuck tables when positioned at said second grinding position to the center of rotation of said rotary spindle of said second spindle unit, such that an area on the respective semiconductor wafer ground by said first grinding wheel corresponds to an area on the respective semiconductor wafer ground by said second grinding wheel.

6. A grinding machine according to claim 5, wherein each of said first and second angles is 180 degrees.

7. A grinding machine according to claim 5, wherein each of said adjustment mechanisms comprises a pair of adjustment screws.

* * * * *